US008297339B2

(12) United States Patent
Yamamoto et al.

(10) Patent No.: US 8,297,339 B2
(45) Date of Patent: Oct. 30, 2012

(54) SEMI-MOLTEN OR SEMI-SOLID MOLDING METHOD

(75) Inventors: Masateru Yamamoto, Sakai (JP); Ryohei Deguchi, Sakai (JP); Satoshi Yamamoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 13/390,322

(22) PCT Filed: Sep. 1, 2010

(86) PCT No.: PCT/JP2010/064893

§ 371 (c)(1),
(2), (4) Date: Feb. 13, 2012

(87) PCT Pub. No.: WO2011/027769

PCT Pub. Date: Mar. 10, 2011

(65) Prior Publication Data

US 2012/0138254 A1 Jun. 7, 2012

(30) Foreign Application Priority Data

Sep. 3, 2009 (JP) ..... 2009-203877

(51) Int. Cl.
*A01H 5/02* (2006.01)
*B22D 27/09* (2006.01)

(52) U.S. Cl. ..... 164/47; 164/113; 164/900

(58) Field of Classification Search ..... 164/47, 164/80, 347, 312, 271, 113, 900
See application file for complete search history.

(56) References Cited

U.S. PATENT DOCUMENTS 6,079,962 A * 6/2000 Seibel et al. ..... 418/55.2
2002/0148592 A1 10/2002 Mori et al.

FOREIGN PATENT DOCUMENTS

JP 1-162563 A 6/1989
JP 8-155626 A 6/1996
JP 2002-310074 A 10/2002
JP 3686412 B2 6/2005

OTHER PUBLICATIONS

Machine Translation of JP-368412-B2.*
International Search Report of corresponding PCT Application No. PCT/JP2010/064893.
International Preliminary Report of corresponding PCT Application No. PCT/JP2010/064893.

* cited by examiner

*Primary Examiner* — Jessica L Ward
*Assistant Examiner* — Steven Ha
(74) *Attorney, Agent, or Firm* — Global IP Counselors

(57) ABSTRACT

A semi-molten or semi-solid molding method is used to cast a scroll member having a tabular panel, a spiral section and a columnar part. The method includes filling a cavity formed inside of the molding die with semi-molten or semi-solid metal from a section for forming the columnar part via a runner that forms a channel. The cavity forms a space for casting the scroll member. An angle of intersection θ1 between the runner and the section for forming the columnar part is set such that to 97°≦θ1≦135°, and/or a ratio R/√S is set such that 0.12≦R/√S≦0.96. R is a radius of curvature of a chamfered section in which the runner intersects the section for forming the columnar part, and √S is the square root of a cross-sectional area S of the section for forming the columnar part.

2 Claims, 9 Drawing Sheets

SEMI-MOLTEN OR SEMI-SOLID MOLDING METHOD

TECHNICAL FIELD

CROSS-REFERENCE TO RELATED APPLICATIONS

This U.S. National stage application claims priority under 35 U.S.C. §119(a) to Japanese Patent Application Nos, 2009-203877, filed in Japan on Sep. 3, 2009, the entire contents of which are hereby incorporated herein by reference.

The present invention relates to a semi-molten or semi-solid molding method for a scroll member.

BACKGROUND ART

In the conventionally used semi-molten molding method referred to as thixo-diecasting, scale (oxide film or the like) is formed on a surface of a starting cylindrical billet by exposing the billet to the air. Accordingly, when the billet is heated to a semi-molten state and formed into a product having a prescribed shape by extruding the semi-molten metal in a mold, there is concern that scale will be allowed to flow into the product section of the moid cavity, and internal defects will be formed.

The influx of scale into the product section of the mold must be prevented because of the concern that blowholes may form and/or a decrease in strength may be occur in the product by these internal defects.

In view of this, in the molding apparatus described in Japanese Patent No. 3686412, a gate component separate from the mold is attached to the section initially in contact with the billet inside of the mold in order to remove the scale near the surface of the billet. The gate component has a narrow-apertured through-hole, and the scale near the surface of the billet is removed when the semi-molten metal flows via the through-hole.

SUMMARY

However, in the molding apparatus described in Japanese Patent No. 3686412 the molded product and the gate component are solidified in a connected state, requiring that the gate component be inserted into the mold for every molding operation, and bringing about problems in which productivity is reduced due to an increase in cycle time.

The gate component is located in a position from which hot semi-molten metal flows in, and is in a location with the harshest temperature and pressure in terms of molding conditions. Damage to the gate component is therefore severe, and there is concern that the service life of the component will be reduced.

In addition, the gate component is necessary for every molding operation, and a quantity of the gate components must therefore be secured. An operation to separate the gate component from the product must also be envisaged when multiple uses are taken into account. This results in an increase in labor and in the cost of components.

In view of this, the present applicants have proposed another method for removing scale without using the gate component. In this method, a section (so-called "scale trap") is provided for collecting scale in an area bent in the form of the letter "L" in the middle of a channel (so-called "runner") for conducting semi-molten metal toward the product part of the mold.

For example, in cases in which a scroll member is manufactured by thixo-diecasting, semi-molten metal is introduced via the runner from a boss section disposed opposite to a helical lap with a panel located between the boss section and the helical lap within the product section of the mold cavity.

However, in cases in which the scale trap is provided in the middle of the channel for conducting semi-molten metal, the runner for conducting semi-molten metal is shaped so as to connect to the side of the boss section of the mold, creating concern that a section (so-called "entrainment part") in which air is entrained will be created in the boss section by the sudden angular variation in the channel when semi-molten metal flows in through the runner toward the boss section.

It is also difficult to completely remove the scale, even in cases in which the scale trap is provided in the middle of such a channel for conducting semi-molten metal.

An object of the present invention is to provide a semi-molten or semi-solid molding method in which the occurrence of air entrainment parts in the boss section can be reduced in cases in which a scroll member is molded by thixo-diecasting.

A semi-molten or semi-solid molding method according to a first aspect of the present invention is a molding method for casting a scroll member from semi-molten or semi-solid metal. The scroll member has a tabular panel, a spiral section projecting from one surface of the panel, and a columnar part projecting from the other surface of the panel on the side opposite to the surface from which the spiral section is projected. In this molding method, a cavity constituting a space for casting the scroll member formed inside of a molding die is filled with the semi-molten or semi-solid metal from the columnar part toward the cavity in the molding die for the scroll member via a runner constituting a channel for filling the space with the semi-molten or semi-solid metal. Also in this molding method, the angle of intersection $\theta 1$, which is the angle at which the runner intersects the columnar part, is set to $97° \leqq \theta 1 \leqq 135°$, and/or the ratio $R/\sqrt{S}$ is set to $0.12 \leqq R/\sqrt{S} \leqq 0.96$, where R is the radius of curvature of a chamfered section in which the runner intersects the columnar part, and $\sqrt{S}$ is the square root of the cross-sectional area S of the columnar part.

Here, the angle of intersection $\theta 1$, which is the angle at which the runner intersects the columnar part, is set to $97° \leqq \theta 1 \leqq 135°$, and/or the ratio $R/\sqrt{S}$ is set to $0.12 \leqq R/\sqrt{S} \leqq 0.96$, where R is the radius of curvature of a chamfered section in which the runner intersects the columnar part, and $\sqrt{S}$ is the square root of the cross-sectional area S of the columnar part, whereby the occurrence of entrainment parts in which air is entrained in the scroll member can be markedly reduced.

A semi-molten or semi-solid molding method according to a second aspect of the present invention is the semi-molten or semi-solid molding method according to the first aspect of the present invention wherein the ratio $L/\sqrt{S}$ is set to $3 \leqq L/\sqrt{S} \leqq 5.6$, where L is the length of the runner, and $\sqrt{S}$ is the square root of the cross-sectional area S of the columnar part.

Here, the ratio $L/\sqrt{S}$ is set to $3 \leqq L/\sqrt{S} \leqq 5.6$, where L is the length of the runner, and $\sqrt{S}$ is the square root of the cross-sectional area S of the columnar part, whereby the influx of scale into the product section of the scroll member can be suppressed.

DESCRIPTION OF EMBODIMENTS

An embodiment of the semi-molten or semi-solid molding method according to the present invention will be described next with reference to the drawings.

<Configuration of Semi-Molten or Semi-Solid Molding Apparatus 1>

Figure 1:
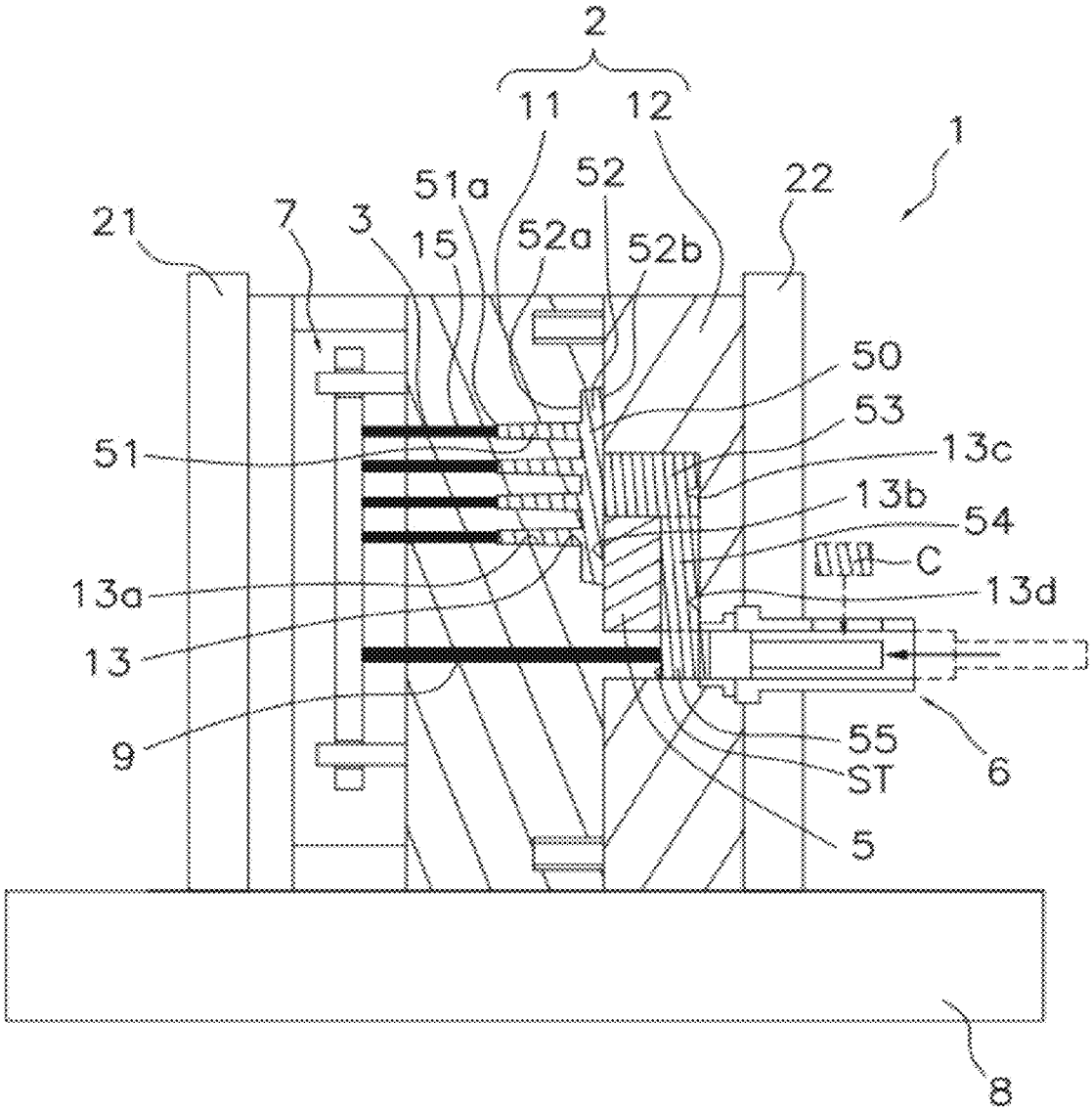
FIG. 1 is a block diagram of a semi-molten or semi-solid molding apparatus for implementing the semi-molten or semi-solid molding method according to an embodiment of the present invention.
Figure 2:
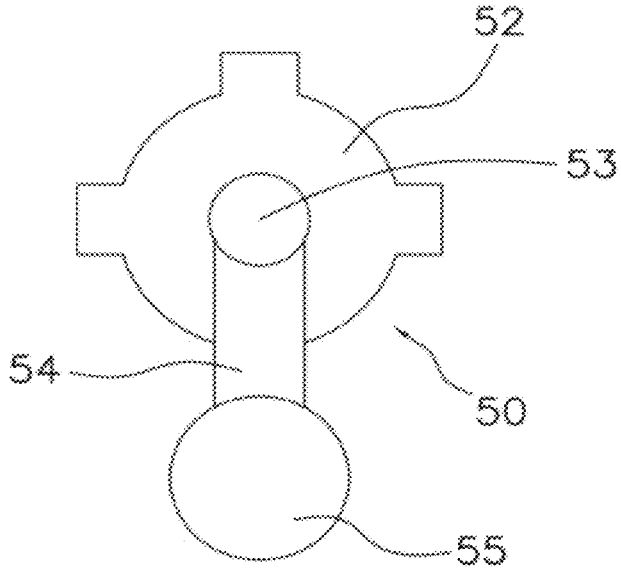
FIG. 2 is a plan view of the scroll member, runner, and residual part of the semi-molten or semi-solid metal material molded in FIG. 1.

The semi-molten or semi-solid molding apparatus 1 (hereinafter referred to as "molding apparatus 1") for performing semi-molten or semi-solid molding shown in FIG. 1 is a molding apparatus for molding a moveable scroll of a scroll compressor, that is, a scroll member 50 including a spiral section 51, a tabular panel 52 formed on the base of the spiral section 51, and a boss 53, which is a column projecting from the panel 52 opposite to the spiral section 51.

The molding apparatus 1 is provided with a scroll member molding die 2 (hereinafter referred to as "molding die 2"), a spiraling extrusion pin 3, an insert or slide die 5, a material-filling mechanism 6, an extrusion-pin driving mechanism 7, and a base frame 8.

The scroll member 50 can be die-molded in the molding apparatus 1 by filling the molding die 2 under pressure with a semi-molten/semi-solid metal material C, which is a ferrous semi-molten or semi-solid metal material, using the material-filling mechanism 6.

Figure 17:
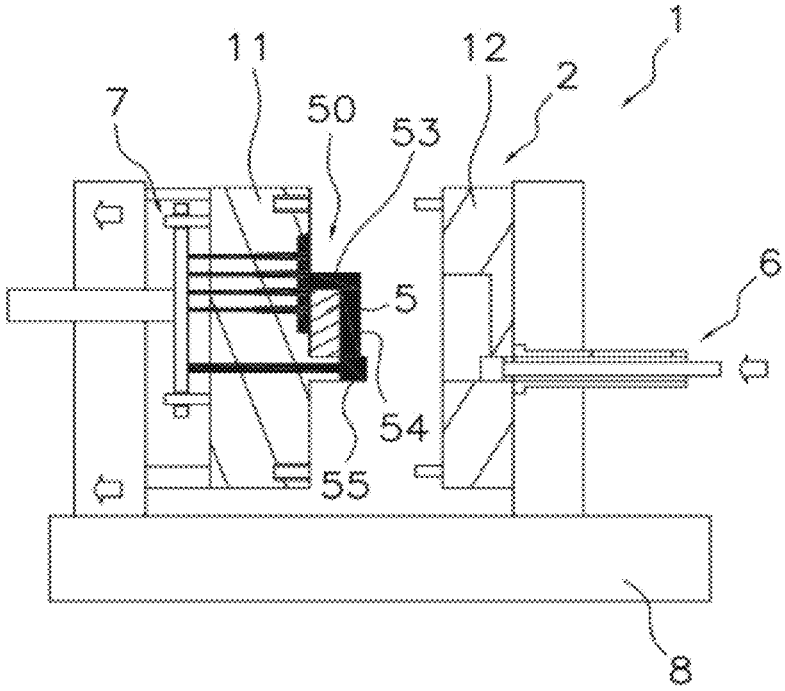
FIG. 17 is a flowchart showing the die-opening process of the semi-molten or semi-solid molding method performed using the molding apparatus of FIG. 1.

After the scroll member 50 is molded, a moveable die 11 constituting the molding die 2 on one side is pulled away from a fixed die 12 on the other side by a driving means (not shown) along the base frame 8 (refer to FIG. 17). The spiraling extrusion pin 3 and a supplemental extrusion pin 9 are then pushed into the moveable die 11 by the extrusion-pin driving mechanism 7, whereby the scroll member 50 can be removed from the inside of the moveable die 11 (refer to FIG. 18).

The molding die 2, the spiraling extrusion pin 3, and the insert or slide die 5 will be described in further detail below in a separate section.

<Configuration of Scroll Member Molding Die 2 and Insert or Slide Die 5>

The molding die 2 has a moveable die 11 that moves back and forth along the base frame 8, and a fixed die 12 fixed on the base frame 8, as shown in FIG. 1.

The molding apparatus 1 is further provided with the insert or slide die 5 in order to form a runner 54 constituting a channel for filling a semi-molten or semi-solid metal material into a casting space, that is, a cavity 13, formed in the shape of the scroll member 50 formed when the moveable die 11 and the fixed die 12 are brought together.

The insert or slide die 5 is disposed between the cavity 13 and the runner 54, and is a member that is separate from the moveable die 11 and the fixed die 12 of the molding die 2.

The insert or slide die 5 is disposed between the cavity 13 and the runner 54 in order to form the runner 54 constituting a channel for filling in a semi-molten or semi-solid metal in the thickness direction of the panel 52 from a second surface 52*b* that is disposed opposite to a first surface 52*a*. The projecting spiral section 51 projects from the first surface of the tabular panel 52.

For example, the slide die 5 can move back and forth in a direction different from the extension direction of the runner 54; that is, in the direction perpendicular to the surface of the paper in FIG. 1, which is orthogonal to the extension direction of the runner 54 in the present embodiment. The slide die 5 can thereby be inserted into and withdrawn from the fixed die 12. The insert 5 may be inserted into the fixed die 12 in the direction perpendicular to the surface of the paper in FIG. 1, which is orthogonal to the extension direction of the runner 54, or may be inserted from the leftward direction in FIG. 1.

A scale trap ST can be provided to a curved part of the runner 54 in order to remove a decarburized layer and/or oxide scale. For example, the scale trap ST is provided projecting from a residual material part 55 in a linear or arcuate shape, as shown in FIG. 1, but the present invention is not limited to this configuration, and the position and shape of the scale trap may be subject to various alterations.

The moveable die 11 has a spiral groove 13*a* for forming the spiral section 51, and a tabular groove 13*b* for forming the panel 52 within the cavity 13 for forming the scroll member 50, as shown in FIG. 1.

The fixed die 12 has a columnar groove 13*c* for forming the boss 53, which is a projecting columnar part, within the cavity 13 for forming the scroll member 50, as shown in FIG. 1. The fixed die 12 also has a runner groove 13*d* for forming the runner 54.

The moveable die 11 is fixed to a moveable platen 21 and can move back and forth together with the moveable platen 21 on the base frame 8. The fixed die 12 is fixed to a fixed platen 22, and is stationary on the base frame 8.

<Configuration of the Spiraling Extrusion Pin 3>

The spiraling extrusion pin 3 shown in FIG. 1 is attached, via a through-hole 15 formed in the moveable die 11, to the extrusion-pin driving mechanism 7 so as to be able to advance to and retract from the distal end of the spiral groove 13*a* of the cavity 13.

The spiraling extrusion pin 3 can push on the distal end 51*a* of the spiral section 51 of the scroll member 50 after the molding of the scroll member 50, and can push the scroll member 50 out from the moveable die 11.

<Summary of the Semi-Molten or Semi-Solid Molding Method>

In the semi-molten or semi-solid molding method in the present embodiment, the cavity 13 constituting the space for casting the scroll member 50 as the molded article formed inside of the molding die 2 is filled with semi-molten or semi-solid metal in the thickness direction of the panel 52 from the second surface 52*b*, which is disposed opposite to the first surface 52*a*. The spiral section 51 projects from the first surface of the panel 52. Molten metal is therefore supplied from the surface on the reverse side which is not the rim of the panel 52 and where the spiral section 51 is not formed, that is, from the second surface 52*b*. The entire cavity 13 can therefore be filled smoothly with semi-molten or semi-solid metal, and the occurrence of fill defects, air entrainment, or cold shut can be prevented as a result.

The scroll member 50 molded in the present embodiment is a moveable scroll and has a columnar boss 53 projecting from the second surface 52*b*, which is disposed opposite to the first surface 52*a*. The spiral section 51 projects from the first surface of the panel 52. Accordingly, the cavity 13 of the molding die 2 for the scroll member 50 is filled, via the runner 54, with semi-molten or semi-solid metal from the boss 53 in the form of a columnar part positioned in the center of the panel 52. The runner is a channel for filling the cavity 13 with semi-molten or semi-solid metal.

The entire cavity 13 (in particular, the entire tabular groove 13*b* for forming the panel 52) can thus be filled smoothly with semi-molten or semi-solid metal because the cavity is filled from the columnar boss 53 of the scroll member 50.

Figure 13:
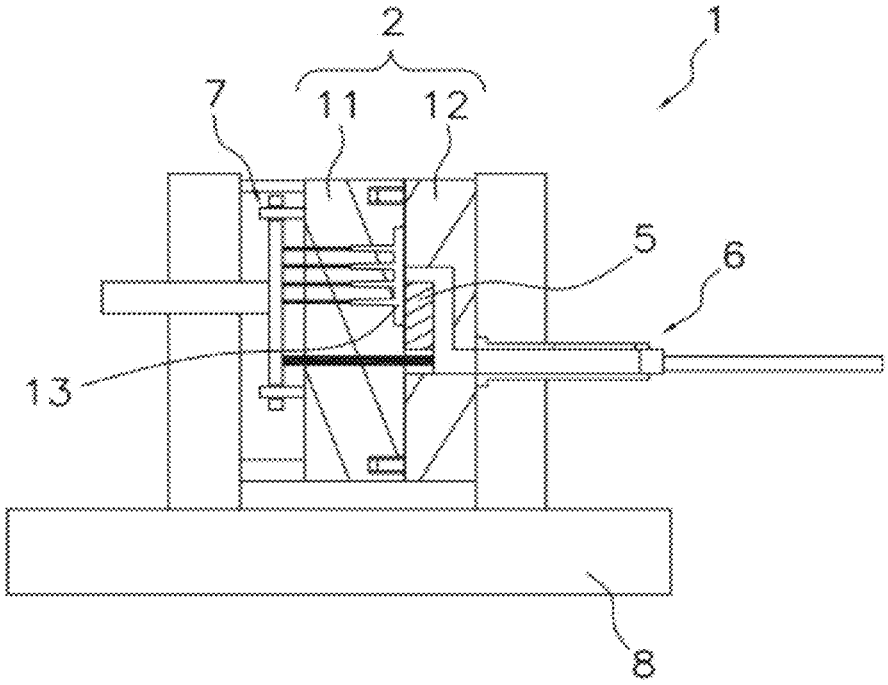
FIG. 13 is a flowchart showing the die-closure process of the semi-molten or semi-solid molding method performed using the molding apparatus of FIG. 1.

One end of the molded runner 54 is connected to the columnar boss 53, and the other end thereof is connected to the residual material part 55 on the side near the material-filling mechanism 6. Accordingly, the molded scroll member 50 is removed from the molding die 2 as shown in FIG. 13, whereupon the runner 54 and the residual material part 55 are cut away.

Because decarburized layers and/or oxide scale on the surface of the semi-molten/semi-solid metal material C formed immediately after exiting the material-filling mechanism 6 are to be removed, the material-filling mechanism 6 is disposed distanced to the extent of the runner 54 without being disposed directly behind the columnar boss 53. The scale removed from the surface of the semi-molten/semi-solid metal material C is thereby collected mainly in the scale trap ST provided in the middle of the residual material part 55 and/or the runner 54, reducing contamination of the scroll member 50 with impurities.

In the present embodiment, the insert or slide die 5 that is separate from the molding die 2 is inserted between the runner 54 and the cavity 13 from a different direction than the extension direction of the runner 54, and the molding die 2 is then filled with semi-molten or semi-solid metal. The runner 54 can thus be extended to the center of the cavity 13 (in particular, the section with the panel 52) by inserting the insert or slide die 5 separate from the molding die 2 into the fixed die 12, and the occurrence of fill defects, air entrainment, or cold shut can be effectively prevented.

<Reduction of Entrainment Parts>

Figure 4:
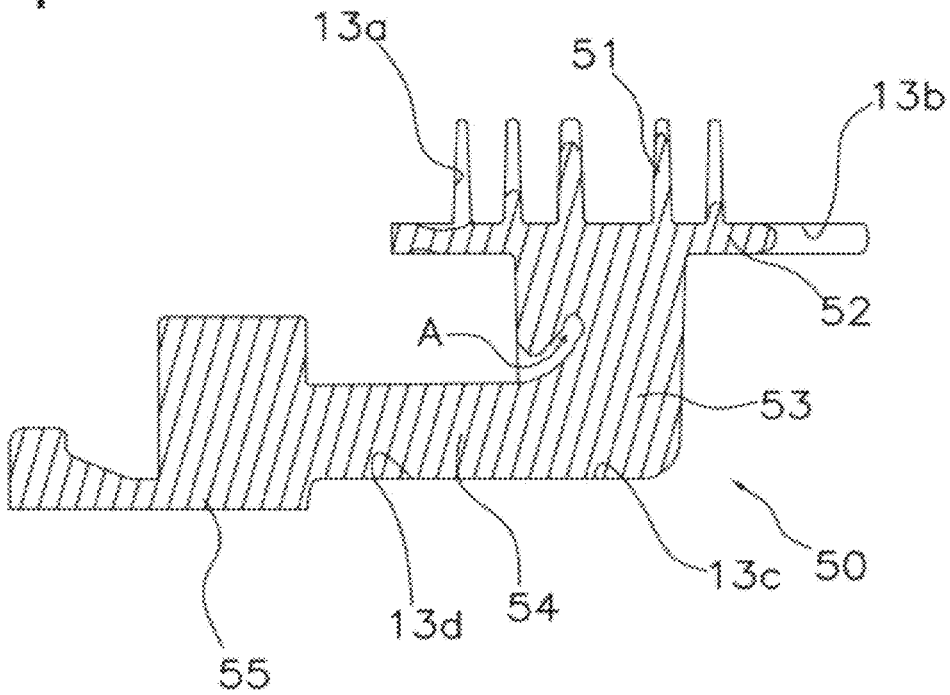
FIG. 4 is a cross-sectional view showing, as a comparative example, a state of the cavity interior during molding of the scroll member in FIG. 1.
Figure 5:
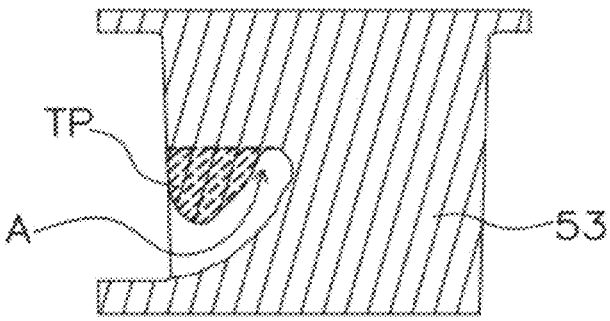
FIG. 5 is an enlarged cross-sectional view showing, as a comparative example, an air entrainment part formed during molding in FIG. 4.
Figure 6:
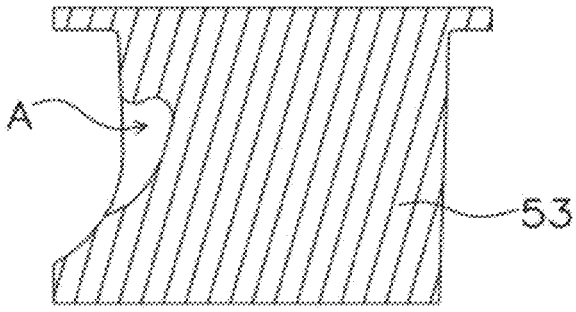
FIG. 6 is an enlarged cross-sectional view showing a state in which an air entrainment part formed during molding is suppressed by the semi-molten or semi-solid molding method according to an embodiment of the present invention.

Here, in a case in which the scale trap ST (refer to FIG. 1) is provided in the middle of the flow channel for the semi-molten/semi-solid metal material C, and in a case in which the scroll member 50 is manufactured by thixo-diecasting as shown in FIGS. 4 to 5, the angle of the channel immediately changes when the semi-molten/semi-solid metal material C that has flowed through the runner groove 13*d* provided with the runner 54 flows into the cylindrical groove 13*c* for forming the columnar boss 53, which is part of the product section of the mold. Accordingly, there is concern that a section in which air is entrained, that is, an entrainment part A, will be formed in the columnar boss 53. The occurrence of such an entrainment part A is the reason for product defects in the scroll member 50.

Figure 3:
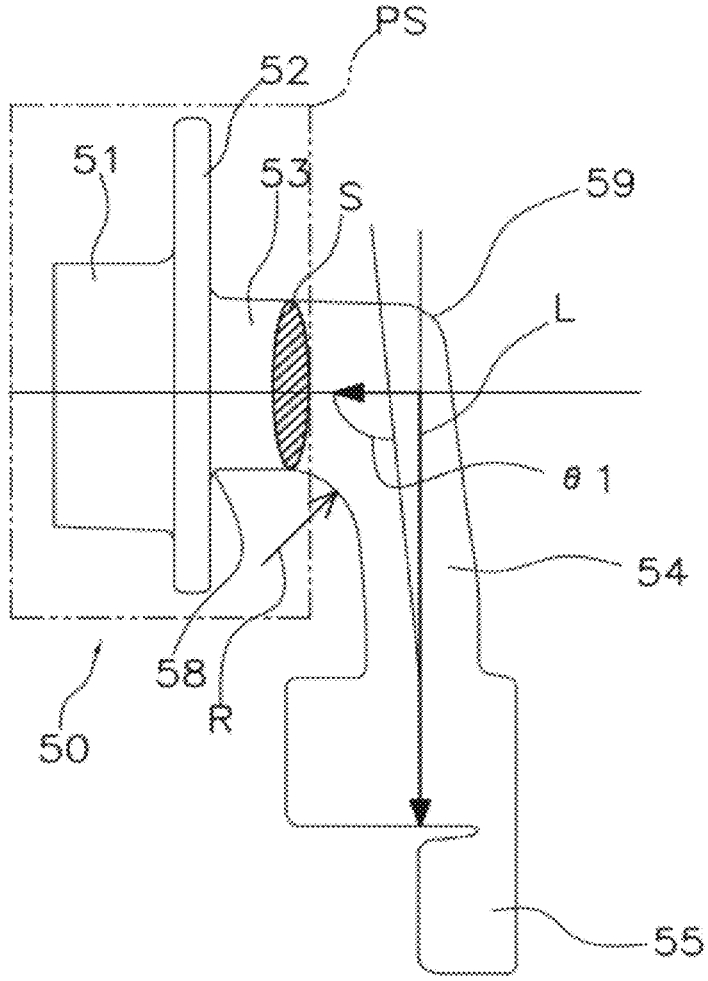
FIG. 3 is a side view of the scroll member, runner, and residual part of the semi-molten or semi-solid metal material molded in FIG. 1.

In view of this, in order to reduce the occurrences of entrainment parts A in the present invention, the angle of intersection θ1, which is the angle at which the runner 54 intersects the columnar boss 53, is set to $97° \leqq \theta 1 \leqq 135°$, and/or the ratio $R/\sqrt{S}$ is set to $0.12 \leqq R/\sqrt{S} \leqq 0.96$, where R is the radius of curvature of the chamfered section in which the runner 54 intersects the columnar boss 53, and $\sqrt{S}$ is the square root of the cross-sectional area S of the columnar boss 53, as shown in FIG. 3. The occurrences of the entrainment parts A can be markedly reduced by establishing these conditions.

Figure 7:
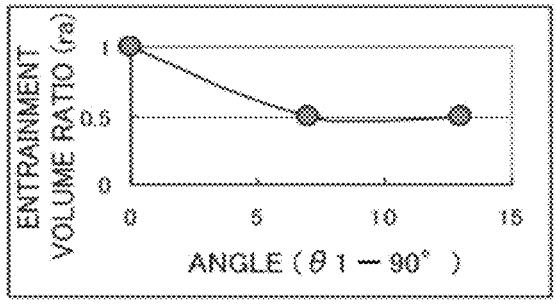
FIG. 7 is a graph showing the relationship between the angle obtained by subtracting 90° from the angle of intersection between the runner and the columnar part, and the entrainment volume ratio.

Specifically, according to the graph shown in FIG. 7, when an angle by which the angle of intersection θ1 of the runner 54 and the columnar boss 53 advances from the right angle (90°) is within a range from 7 to 45° (that is, $97° \leqq \theta 1 \leqq 135°$), the entrainment volume ratio ra, which is a judgement value of the entrainment volume, is reduced to 0.5 or less in comparison with the reference value of 1 for a case in which the angle of intersection θ1 is the right angle (0° angle in the graph in FIG. 7).

As used herein, the term "entrainment volume ratio ra" refers to the ratio of the cross-sectional area of the tongue part TP (refer to FIG. 5) in a case in which the angle of intersection θ1 is varied, where the ratio is in relation to the cross-sectional area of the tongue part TP that encloses the entrainment part A formed in a case in which the angle of intersection θ1 is the right angle (0° angle in the graph in FIG. 7).

In further detail, the cross-sectional area of the tongue part TP is the cross-sectional area of the longitudinal section of the tongue part TP as viewed in the longitudinal section of the columnar boss 53. The surface area corresponding to the cross-sectional area of the tongue part TP can be calculated by starting from the time at which the region in which air is trapped into the cylindrical groove 13*c* by the semi-molten/semi-solid metal material C, and adding together the longitudinal surface areas of the growing tongue part TP every $1/100^{th}$ of a second using, for example, a computer simulation as a calculation method for the cross-sectional area of the tongue part TP.

The relationship between the angle of intersection and the runner is that the length of the runner 54 during molding of the scroll member 50 increases with the increased angle of intersection θ1, but an excessively long runner 54 is unsuitable in practical terms because such a runner results in a large amount of wasted material and large mold dimensions. Considering these practical limitations, the maximum value of the angle of intersection θ1 in practical terms is preferably 105° (15° in the graph in FIG. 7), and a range of 97°≦θ1≦105° is therefore more preferable in practical terms for the angle of intersection θ1.

Figure 8:
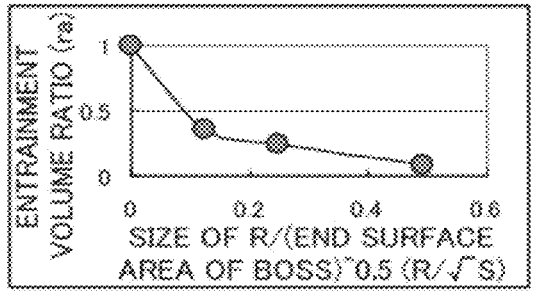
FIG. 8 is a graph showing the relationship with a ratio expressed as the proportion of the radius of curvature of the chamfered section in which the runner intersects the columnar part, in relation to the square root of the cross-sectional area of the boss.

According to the graph in FIG. 8, it is understood that the entrainment volume ratio ra is reduced to 0.5 or less in comparison with the reference value of 1 for the right angle (0° angle in the graph in FIG. 8) when the ratio R/√S is set to 0.12≦R/√S≦0.96, where R is the radius of curvature of the chamfered section in which the runner 54 intersects the columnar boss 53, and √S is the square root of the cross-sectional area S of the columnar boss 53.

Here, the cross-sectional area S of the columnar boss 53 in the graph in FIG. 8 is the surface area of the end part; that is, the end surface area of the section used as the product section PS (refer to FIG. 3), which is itself used as the product obtained after the cutting and finishing are ultimately performed, and which is part of the scroll member 50.

Figure 9:
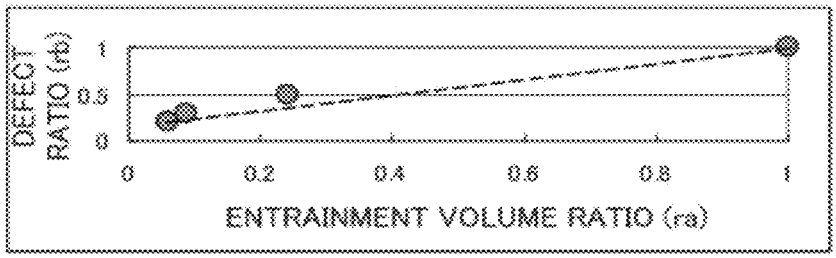
FIG. 9 is a graph showing the relationship between the entrainment volume ratio and the defect ratio.

Next, the graph shown in FIG. 9 demonstrates that when the entrainment volume ratio ra in FIGS. 7 to 8 is reduced to 0.5 or less, the defect ratio rb, which is a judgement value of the occurrence of defective products, can also be reduced to a value of about 0.6 or less.

As used herein, the term "defect ratio rb" refers to the ratio of the proportion in which defective products are generated in cases in which the angle of intersection θ1 is varied, where the ratio is in relation to the proportion in which defective products are generated in cases in which the angle of intersection θ1 is the right angle (0° angle in the graph in FIG. 7).

It follows from the above that the angle of intersection θ1 is set to 97°≦θ1≦135° and/or that the ratio R/√S is set to 0.12≦R/√S≦0.96, where R is the radius of curvature of the chamfered section in which the runner 54 intersects the columnar boss 53, and √S is the square root of the cross-sectional area S of the columnar boss 53. The occurrence of entrainment parts A can be markedly reduced, and the proportion in which defective parts are generated can also be reduced, by establishing these conditions.

The roundness (R) of a corner part 58 between the panel 52 and the columnar boss 53, and the roundness (R) of an exterior corner part 59 between the columnar boss 53 and the runner 54 are matters of design, may be selected appropriately, and are not related in any particular way to the defects occurring in the entrainment parts A.

<Suppression of Scale Influx>

However, scale is difficult to completely remove even in cases in which a scale trap ST is provided in the middle of the runner groove 13*c* corresponding to the runner 54 for conducting the semi-molten/semi-solid metal material C as described above.

In view of this, in the present embodiment, the ratio L/√S is set to 3≦L/√S≦5.6, where L is the length of the runner 54, and √S is the square root of the cross-sectional area S of the columnar boss 53 as shown in FIG. 3, in order to suppress the influx of scale into the product section PS, which is itself used as the product obtained after the cutting and finishing are ultimately performed, and which is part of the scroll member 50. The influx of scale into the product section PS of the scroll member 50 can be markedly suppressed by establishing this condition.

Figure 10:
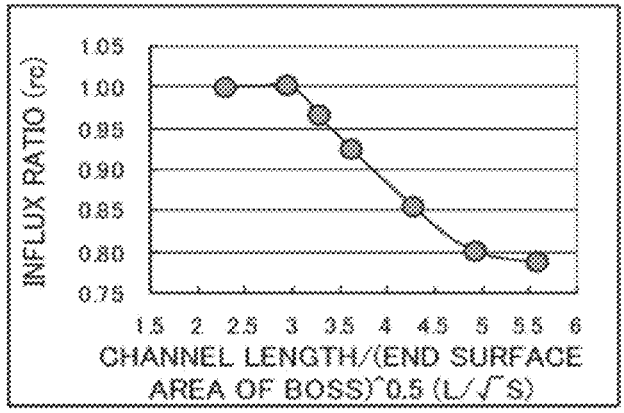
FIG. 10 is a graph showing the relationship with the ratio of the length of the runner relative to the square root of the cross-sectional area of the columnar part.
Figure 11:
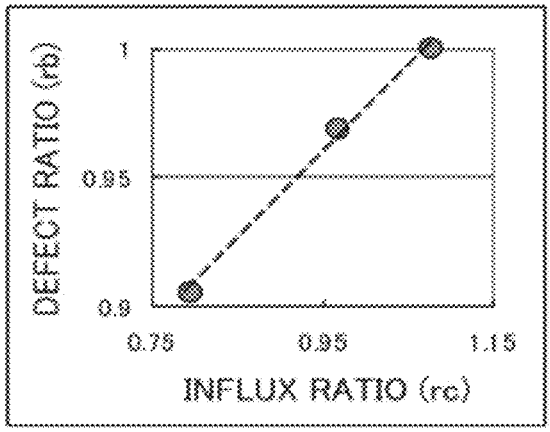
FIG. 11 is a graph showing the relationship between the influx ratio and the defect ratio.

Specifically, according to the graph shown in FIG. 10, when the ratio L/√S is set to 3≦L/√S≦5.6, where L is the length of the runner 54, and √S is the square root of the cross-sectional area S of the columnar boss 53, the influx ratio rc, which is a judgement value of scale influx, is markedly reduced in comparison with the reference value of 1 for the case of L/√S=2. In addition, according to the graph shown in FIG. 11, the defect ratio rb also decreases with decreased influx ratio rc.

As used herein, the term "influx ratio rc" refers to the ratio of the influx volume when L is varied (that is, when L/√S is varied), where the ratio is in relation to the volume of scale influx into the product section PS in the case of L/√S=2.

The term "channel length" in the graph in FIG. 10 is the length L of the runner 54, and the channel length extending up to the product section PS such as in FIG. 3 is adopted for measurement purposes.

Here, the ratio L/√S and the length L are related to each other so that the length of the runner 54 during molding of the scroll member 50 increases as L/√S increases, but an excessively long runner 54 is unsuitable in practical terms because such a runner results in a large amount of wasted material and large mold dimensions. Considering these practical limitations, the maximum value of L/√S in practical terms is preferably 3.28, and a range of 3≦L/√S≦3.28 is therefore more preferable in practical terms for L/√S.

<Procedure for Semi-Molten or Semi-Solid Molding Method>

The semi-molten or semi-solid molding method using the molding apparatus 1 of the present embodiment will be described next with reference to FIGS. 12 to 19.

Figure 12:
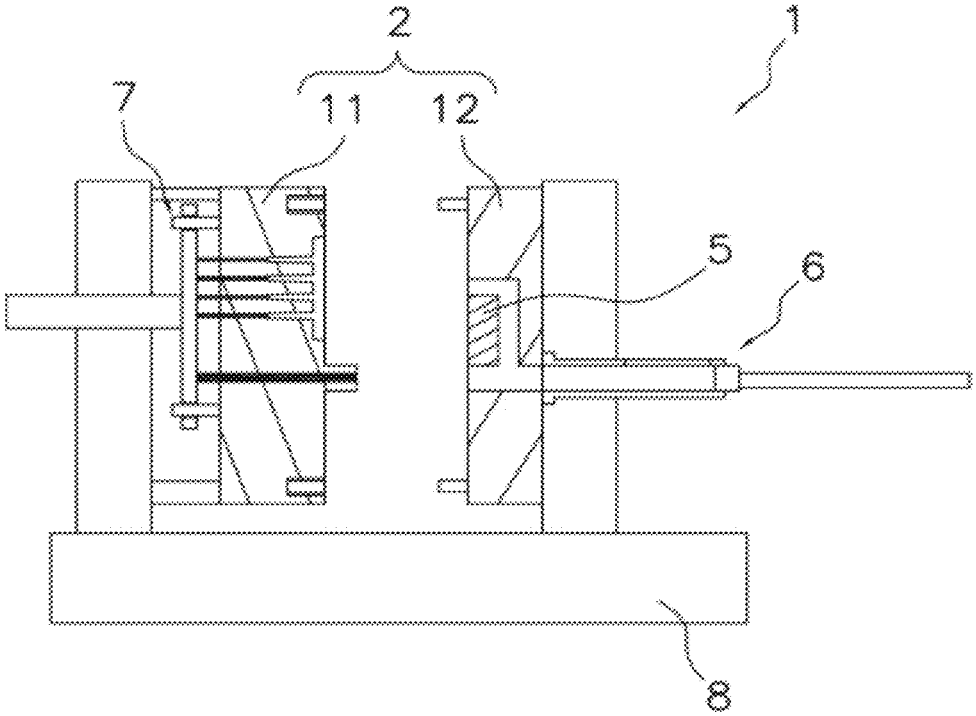
FIG. 12 is a flowchart showing the initial state of the semi-molten or semi-solid molding method performed using the molding apparatus of FIG. 1.

Based on the initial conditions shown in FIG. 12, the moveable die 11 is first moved along the base frame 8, and the moveable die 11 and the fixed die 12 are linked together to form the cavity 13 (die-closure process), as shown in FIG. 13.

Figure 14:
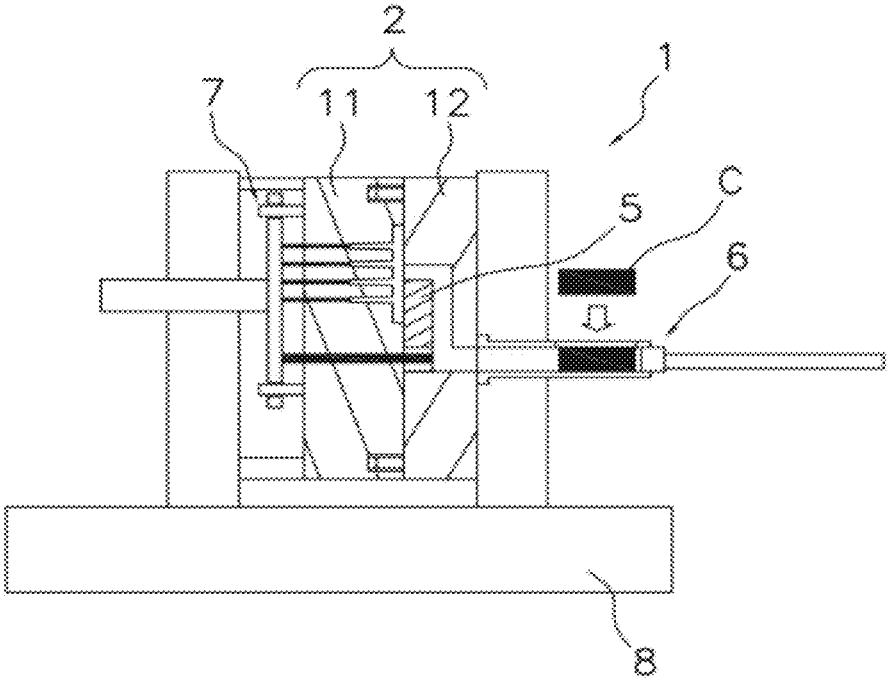
FIG. 14 is a flowchart showing the material-injection process of the semi-molten or semi-solid molding method performed using the molding apparatus of FIG. 1.

The semi-molten/semi-solid metal material C is then deposited into the material-filling mechanism 6 (material-injection process), as shown in FIG. 14.

Figure 15:
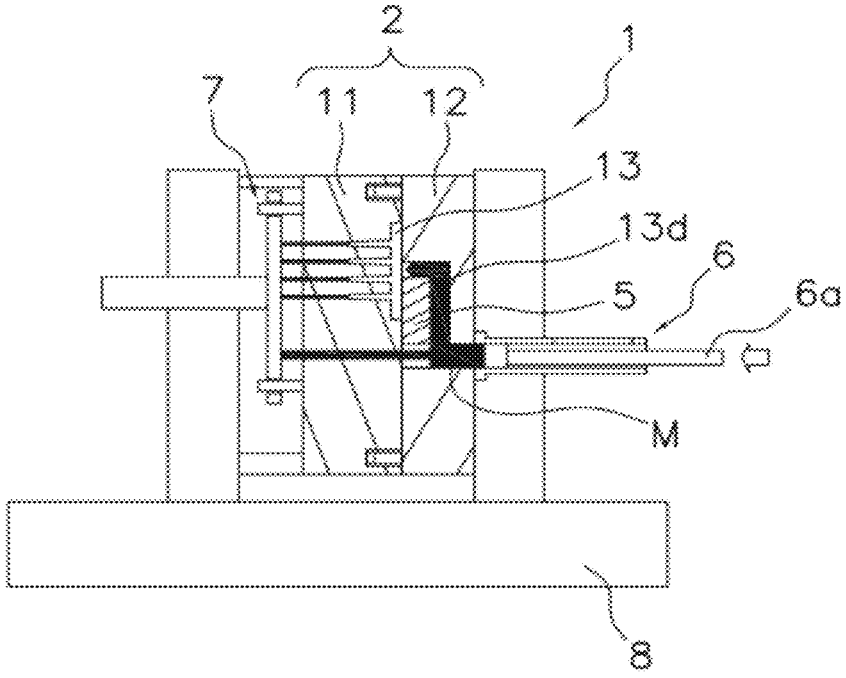
FIG. 15 is flowchart showing the filling process of the semi-molten or semi-solid molding method performed using the molding apparatus of FIG. 1.

A plunger 6*a* of the material-filling mechanism 6 is then moved by hydraulics or pneumatics to fill the molding die 2 under pressure with the semi-molten/semi-solid metal material C (filling process), as shown in FIG. 15. At this time, a semi-molten/semi-solid metal M, which is halfway filled into the molding die, is filled into the cavity 13 via the runner groove 13*d*.

Figure 16:
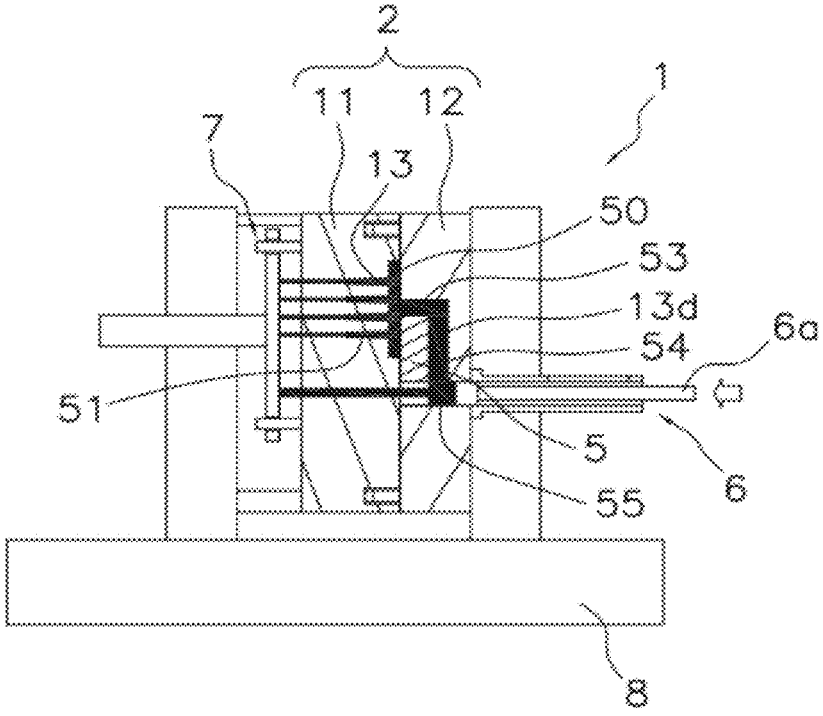
FIG. 16 is a flowchart showing the filling completion state of the semi-molten or semi-solid molding method performed using the molding apparatus of FIG. 1.

Filling of the entire cavity 13 with the semi-molten/semi-solid metal M is then completed, whereupon the molded scroll member 50 is molded in the cavity 13 when the semi-molten/semi-solid metal M has cooled and solidify (filling complete), as shown in FIG. 16. The molded scroll member 50 is connected to the runner 54 formed in the runner groove 13*d* and the residual material part 55.

The moveable die 11 is then moved along the base frame 8, the moveable die 11 is separated from the fixed die 12, and the molding die 2 is opened (die-opening process), as shown in FIG. 17. At this time, the insert or slide die 5 is interposed between the scroll member 50 and the runner 54.

Figure 18:
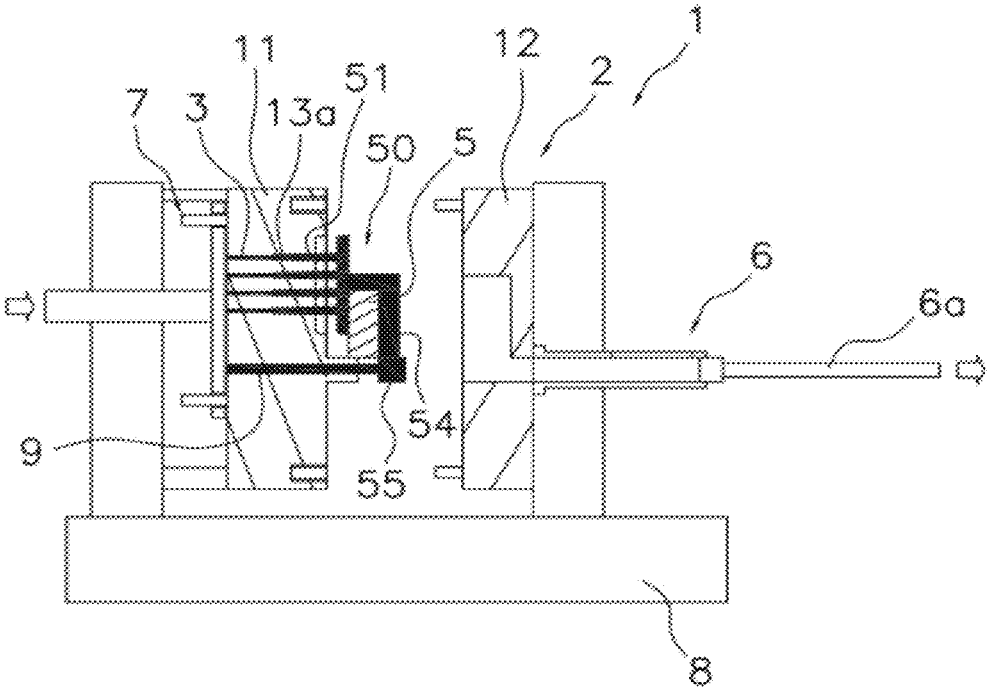
FIG. 18 is a flowchart showing the extrusion state of the semi-molten or semi-solid molding method performed using the molding apparatus of FIG. 1.

In cases in which the insert is used as the insert or slide die 5, the extrusion-pin driving mechanism 7 is driven and the spiraling extrusion pin 3 is projected into the spiral groove 13*a* of the moveable die 11, whereby the spiraling extrusion pin 3 pushes on the spiral section 51 of the scroll member 50, as shown in FIG. 18. The supplemental extrusion pin 9 is also projected from the moveable die 11 and caused to push the residual material part 55 by the drive of the extrusion-pin driving mechanism 7. The integrated molded scroll member 50, runner 54, residual material part 55, and insert 5 in the moveable die 11 can thereby be pushed out of the moveable die 11 (pushing-out process). The plunger 6*a* is returned to the initial position at the same time as the components are pushed out.

In cases in which the slide die is used as the insert or slide die 5, the slide die 5 is divided in two parts, and the two parts of the slide die 5 are driven in mutually separate directions along the direction perpendicular to the surface of the paper in FIG. 18 to open the slide die 5 using a slide-die driving mechanism (not shown) or the like provided to the moveable die 11 or the like before the extrusion-pin driving mechanism 7 is driven. The extrusion-pin driving mechanism 7 is then driven to allow only the integrated molded scroll member 50, runner 54, and residual material part 55 to be pushed out of the moveable die 11.

Figure 19:
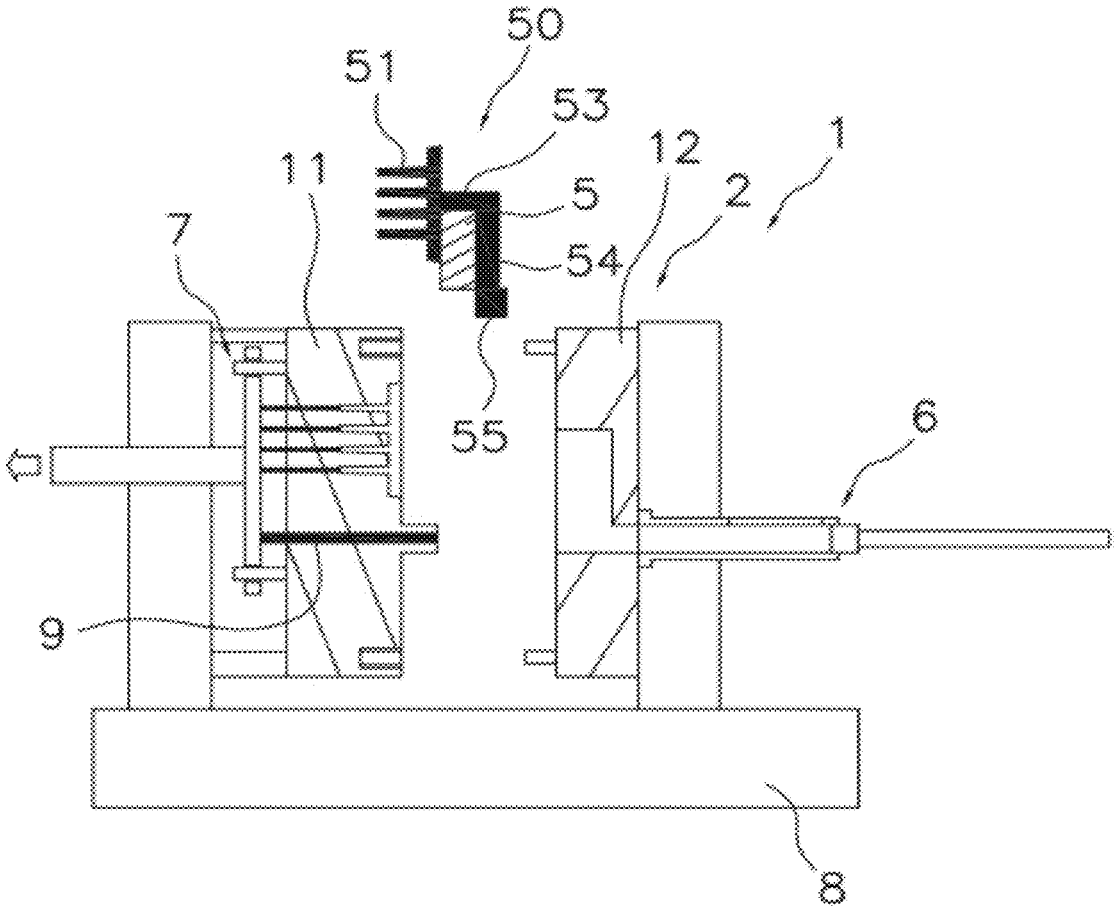
FIG. 19 is a flowchart showing the molded article removal process of the semi-molten or semi-solid molding method performed using the molding apparatus of FIG. 1.

Finally, the integrated molded scroll member 50, runner 54, residual material part 55, and the insert 5 are removed from the molding die 2 (molded article removal process), as shown in FIG. 19. At this time, the spiraling extrusion pin 3 and the supplemental extrusion pin 9 are returned to the initial position in FIG. 12.

The molded scroll member 50 is cut at the boundary sections of the runner 54 and the columnar boss 53, and is separated from the runner 54 and the residual material part 55. The insert 5 interposed between the scroll member 50 and the runner 54 is also separated together therewith.

The final finishing treatment of the scroll member 50 involves finishing the surface of the member on an endmill, mounted grinding wheel, aero lap, or the like, whereby the scroll member 50 can be finished to the dimensions and surface roughness required for the completed product.

<Characteristics>

(1) In the present embodiment, the angle of intersection θ1, which is the angle at which the runner 54 intersects the columnar boss 53, is set to $97° \leqq \theta 1 \leqq 135°$, and/or the ratio $R/\sqrt{S}$ is set to $0.12 \leqq R/\sqrt{S} \leqq 0.96$, where R is the radius of curvature of the chamfered section in which the runner 54 intersects the columnar boss 53, and $\sqrt{S}$ is the square root of the cross-sectional area S of the columnar boss 53.

The occurrence of entrainment parts A in which air is entrained in the scroll member 50 can thereby be markedly reduced. As a result, the product yield in thixo-diecasting of the scroll member is improved. In addition, the labor required for the cutting and finishing process after thixo-diecasting can also be markedly reduced.

(2) In the present embodiment, the ratio $L/\sqrt{S}$ is set to $3 \leqq L/\sqrt{S} \leqq 5.6$, where L is the length of the runner 54, and $\sqrt{S}$ is the square root of the cross-sectional area S of the columnar boss 53. The influx of scale into the product section PS of the scroll member 50 can thereby be suppressed. As a result, the product yield of the scroll member 50 can be further improved.

(3) In the present embodiment, the cavity 13 constituting the space for casting the scroll member 50 as the molded article formed inside of the molding die 2 is filled with semi-molten or semi-solid metal in the thickness direction of the panel 52 from the second surface 52*b*, which is disposed opposite to the first surface 52*a*. The spiral section 51 projects from the first surface of the panel 52. Molten metal is therefore supplied from the back surface which is not the rim of the panel 52 and where the spiral section 51 is not formed; that is, from the second surface 52*b*. The entire cavity 13 can therefore be filled smoothly with semi-molten or semi-solid metal, and the occurrence of fill defects, air entrainment, or cold shut can be prevented as a result.

(4) Furthermore, in the present embodiment, the molded scroll member 50 is a moveable scroll and has a columnar boss 53 projecting from the second surface 52*b*, which is disposed opposite to the first surface 52*a*. The spiral section 51 projects from the first surface of the panel 52. Accordingly, in the molding method of the present embodiment, the cavity 13 of the molding die 2 for the scroll member 50 is filled, via the runner 54, with semi-molten or semi-solid metal from the section with the columnar boss 53. The entire cavity 13 (in particular, the entire tabular groove 13*b* for forming the panel 52) can thus be filled smoothly with semi-molten or semi-solid metal because the cavity is filled from the columnar boss 53 of the scroll member 50. Filling defects can therefore be more effectively prevented, and a high-quality scroll member 50 can be manufactured.

Industrial Applicability

The present invention can be used in a semi-molten or semi-solid molding method for performing casting using semi-molten or semi-solid metal via a runner in order to cast a scroll member shaped so as to have a columnar part projecting from a surface disposed opposite to a spiral section across a panel. Accordingly, a fixed scroll can also be molded using the molding method of the present invention as long as the scroll member is shaped so as to have a projecting columnar part. The molding method of the present invention can also be used in cases in which the columnar part is removed after molding.

What is claimed is:

1. A semi-molten or semi-solid molding method using a molding die in order to cast, with semi-molten or semi-solid metal, a scroll member having a tabular panel, a spiral section projecting from one surface of the panel, and a columnar part projecting from an other surface of the panel on a side opposite to the surface from which the spiral section is projected, the semi-molten or semi-solid molding method comprising:

filling a cavity formed inside of the molding die with the semi-molten or semi-solid metal from a section for forming the columnar part via a runner that forms a channel, the cavity forming a space for casting the scroll member, at least one of an angle of intersection θ1 between the runner and the section for forming the columnar part being set such that $97° \leqq \theta 1 \leqq 135°$ and a ratio $R/\sqrt{S}$ being set such that $0.12 \leqq R/\sqrt{S} \leqq 0.96$, where R is a radius of curvature of a chamfered section in which the runner intersects the section for forming the columnar part, and $\sqrt{S}$ is the square root of a cross-sectional area S of the section for forming the columnar part.

2. The semi-molten or semi-solid molding method according to claim 1, wherein a ratio $L/\sqrt{S}$ is set such that $3 \leqq L/\sqrt{S} \leqq 5.6$, where L is a length of the runner.

* * * * *